US007485057B2

(12) United States Patent
Afshari

(10) Patent No.: US 7,485,057 B2
(45) Date of Patent: Feb. 3, 2009

(54) ARROW FLETCHING ASSEMBLY

(76) Inventor: Abbas Ben Afshari, P.O. Box 6005, Pocatello, ID (US) 83205

( * ) Notice: Subject to any disclaimer, the term of this patent is extended or adjusted under 35 U.S.C. 154(b) by 217 days.

(21) Appl. No.: 11/059,837

(22) Filed: Feb. 17, 2005

(65) Prior Publication Data

US 2006/0183579 A1 Aug. 17, 2006

(51) Int. Cl.
*F42B 6/06* (2006.01)

(52) U.S. Cl. ..... 473/586

(58) Field of Classification Search ..... 473/578, 473/585, 586

See application file for complete search history.

(56) References Cited

U.S. PATENT DOCUMENTS 1,628,376 A 11/1927 Blodgett
1,748,200 A 2/1930 Bangart
1,842,540 A 1/1932 Cowdery
1,896,536 A 2/1933 Belshaw
1,945,416 A 1/1934 Birchall
2,193,397 A 3/1940 Dykes
2,277,743 A 3/1942 Crossman
2,286,574 A 6/1942 Rohde
2,525,332 A 10/1950 Alger et al.
2,731,992 A 1/1956 Lozon
2,742,064 A 4/1956 Quist
2,782,036 A 4/1957 Folberth, Jr. et al.
2,830,818 A 4/1958 Otto
2,836,208 A 5/1958 Hoyt, Jr.
2,869,597 A 1/1959 Lozon
2,884,034 A 4/1959 Portinga
2,887,319 A 5/1959 Lay
2,891,794 A 6/1959 Meyer
2,918,097 A 12/1959 Thompson
2,976,042 A 3/1961 Barnett
3,015,483 A 1/1962 Martin
3,024,017 A 3/1962 Stanton
3,027,156 A 3/1962 Schnoor
3,106,400 A 10/1963 Zwickey
3,108,792 A 10/1963 Martin
3,322,421 A 5/1967 Sisty
3,333,842 A 8/1967 Bitzenburger
3,428,321 A * 2/1969 Manning ..... 473/586
D219,040 S 10/1970 Jaffe et al.
3,539,187 A 11/1970 Smith
3,595,579 A 7/1971 Benoit
3,749,403 A 7/1973 Austin et al.
3,756,602 A 9/1973 Carella
3,815,916 A * 6/1974 Meszaros ..... 473/586
3,853,320 A 12/1974 Carella
3,865,374 A 2/1975 Troncoso
3,895,802 A 7/1975 Bear
3,922,410 A 11/1975 Halloran
3,923,310 A 12/1975 Lowy
4,009,875 A 3/1977 Erlandson
4,012,043 A 3/1977 Carella
4,204,307 A 5/1980 Pfetzing
4,234,192 A 11/1980 Salamone (Continued)

*Primary Examiner*—John Ricci
(74) *Attorney, Agent, or Firm*—Morriss O'Bryant Compagni, PC

(57) ABSTRACT

An arrow fletching assembly is disclosed. An embodiment of the arrow fletching assembly may include a tubular sleeve about which a plurality of feathers or vanes may be attached. Another embodiment may include graphics printed on the tubular sleeve or on a sticker that is configured for application on the tubular sleeve. Embodiments of the arrow fletching assembly may be field adjustable according to the present invention.

13 Claims, 5 Drawing Sheets

U.S. PATENT DOCUMENTS 4,366,022 A 12/1982 Coffman
4,392,654 A 7/1983 Carella
4,468,189 A 8/1984 Carella
4,510,109 A 4/1985 Carella
4,615,552 A * 10/1986 Bengtson ..... 473/586
4,749,175 A 6/1988 Grabits
4,867,426 A 9/1989 Mellick
4,919,405 A 4/1990 York
5,039,110 A 8/1991 Honda
5,061,008 A 10/1991 Saunders
5,211,382 A 5/1993 Finlay
5,423,553 A 6/1995 Krieg
5,427,385 A 6/1995 Conrad et al.
5,443,272 A * 8/1995 Vincent, Sr. ..... 473/578
5,465,981 A 11/1995 Klaus
5,613,688 A 3/1997 Carella
5,897,449 A 4/1999 Roberts et al.
5,951,419 A 9/1999 Cameneti
6,203,457 B1 3/2001 Snook
6,220,978 B1 4/2001 Schroeder
6,544,129 B2 * 4/2003 Todd ..... 473/318
6,641,493 B1 * 11/2003 Shifflett ..... 473/578
6,695,727 B1 2/2004 Kuhn
7,074,143 B2 * 7/2006 Czemske et al. ..... 473/586
2002/0028718 A1 * 3/2002 Coe ..... 473/586
2005/0178375 A1 * 8/2005 Sutherland et al. ..... 124/79

* cited by examiner

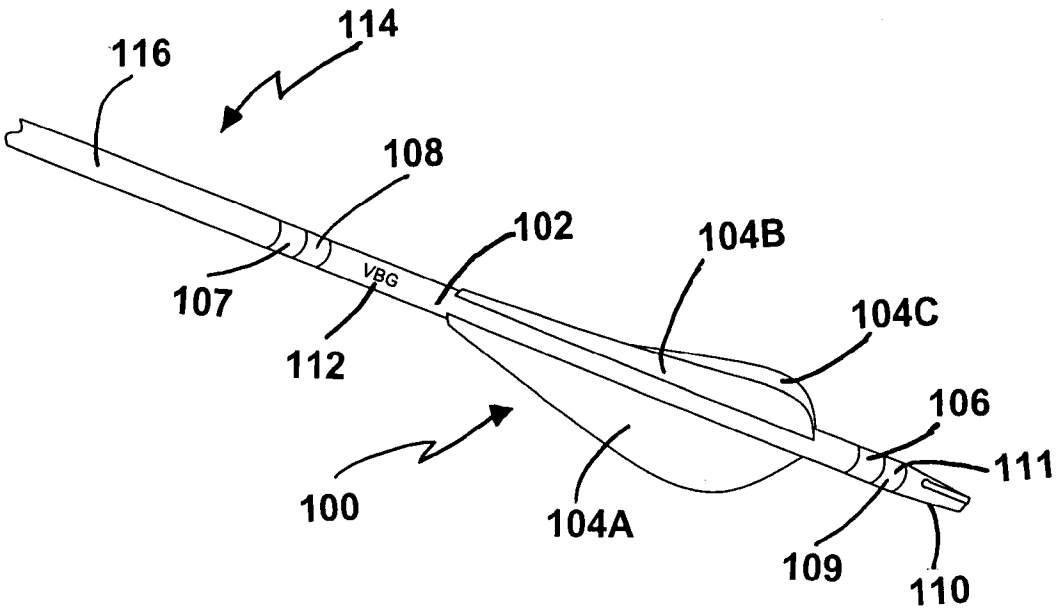
FIG. 1
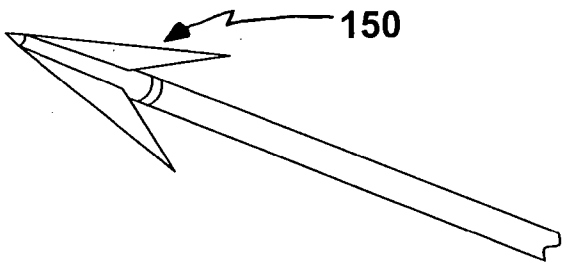

ARROW FLETCHING ASSEMBLY

BACKGROUND OF THE INVENTION

1. Field of the Invention

The present invention relates generally to arrows. More particularly, the present invention relates to an arrow fletching assembly.

2. State of the Art

Arrows generally include an arrow shaft having an arrow head mounted on one end of the shaft and a nock on the opposite end of the arrow shaft. Arrows also typically include fletching mounted near the nock on the opposite end of the arrow shaft. Fletching typically includes three or four feathers or vanes which may be mounted helically along the arrow shaft to promote spinning of the arrow during flight.

Conventionally, the plurality of feathers or vanes of the fletching is adhered to the surface of the arrow shaft using epoxy or some other suitable adhesive. The feathers or vanes are typically evenly spaced around the circumference of the arrow shaft. For example, where three feathers are employed, each of the three feathers is approximately 120° apart from adjacent feathers. The nock is also generally fixed in place relative to the arrow fletching. Once the feathers or vanes and nock have been adhered to the arrow shaft, it is difficult to adjust their relative positions without removing one, the other or both. This makes field adjustment of the fletching unlikely. Additionally, there may be other instances where the ability to field tune the fletching for a particular broadhead or other arrow head may be desirable.

Conventional arrow fletching may include various colors. However, it would be advantageous to have bright and highly visible colors and arbitrary graphics associated with arrow fletching to make them more visible for retrieving or for displaying trademarks and other indicia.

Accordingly, there exists a need in the art for an arrow fletching assembly that is field adjustable and can accommodate a variety of arrow shaft configurations. There further exists a need in the art for an arrow fletching assembly that is highly visible for ease of locating after shooting in the field. There exists a further need for an arrow fletching assembly that is configured for graphics and other indicia.

BRIEF SUMMARY OF THE INVENTION

Accordingly, the present invention relates to an arrow fletching assembly for use with arrows. An embodiment of the arrow fletching assembly may include a tubular sleeve about which a plurality of feathers or vanes may be attached.

Another embodiment may include graphics printed on the tubular sleeve or on a sticker or adhesive backed material in sheet form that is configured for application on the tubular sleeve. Embodiments of the arrow fletching assembly may be field adjustable according to the present invention.

An advantageous feature of embodiments of the present invention may include a reflective or self-illuminating overlay or sticker having high visibility for retrieving arrows even in the dark. Another advantage of embodiments of the arrow fletching assembly of the present invention may include field tunable fletching for various broad heads and other arrow heads. Yet another advantage of embodiments of the arrow fletching assembly of the present invention may include capability for taping the arrow fletching assembly in place on either or both ends of the arrow fletching assembly to secure it to an arrow shaft. Yet another advantage of embodiments of the arrow fletching assembly of the present invention may include easy removability. Embodiments of the arrow fletching assembly do not need to be scraped off when replacing or adjusting, thus, preserving arrow shaft integrity. This feature further allows for field adjustment of the fletching for correct placement of a cock feather without moving nock.

Yet another advantage of embodiments of the arrow fletching assembly of the present invention may include custom fletching. Feathers, vinyl vanes, sizes, colors, graphics, indicia and various configurations are possible according to embodiments of the present invention. Yet another advantage of embodiments of the arrow fletching assembly of the present invention may include a split sleeve configuration to allow for larger outside diameter arrow shafts. Another feature of embodiments of the arrow fletching assembly of the present invention may include a tubular sleeve configured to stretch slightly to provide an interference fit or snug fit around the arrow shaft. Another feature of embodiments of the arrow fletching assembly of the present invention may include a tubular sleeve configuration employing shrink wrap material to achieve an interference fit. Additionally, the feathers or vanes may be packaged or supplied separate from the tubular sleeve according to embodiments of the present invention.

The arrow fletching assembly may include a sticker having an adhesive side and a graphics side. The arrow fletching assembly may further include a tubular sleeve having an inner surface configured to encircle an arrow shaft and having an outer surface for receiving the adhesive side of the sticker. The arrow fletching assembly may further include a plurality of feathers attached to the sticker.

In another embodiment of an arrow fletching assembly, a tubular sleeve has an inner surface configured to encircle an arrow shaft and an outer surface configured with high visibility graphics or "glow-in-the-dark" material. The embodiment of an arrow fletching assembly may further include a plurality of vanes attached to the outer surface of the tubular sleeve.

The foregoing advantages and characterizing features will become apparent from the following description of certain illustrative embodiments of the invention. The above-described features and advantages of the present invention, as well as additional features and advantages, will be set forth or will become more fully apparent in the detailed description that follows and in the appended claims. The novel features which are considered characteristic of this invention are set forth in the attached claims. Furthermore, the features and advantages of the present invention may be learned by the practice of the invention, or will be obvious to one skilled in the art from the description, as set forth hereinafter.

BRIEF DESCRIPTION OF THE SEVERAL VIEWS OF THE DRAWINGS

The following drawings illustrate exemplary embodiments for carrying out the invention. Like reference numerals refer to like parts in different views or embodiments of the present invention in the drawings.

FIG. 1 is a perspective side view of an arrow fletching assembly mounted on an arrow in accordance with the principles of the present invention.

DETAILED DESCRIPTION OF THE INVENTION

Figure 2:
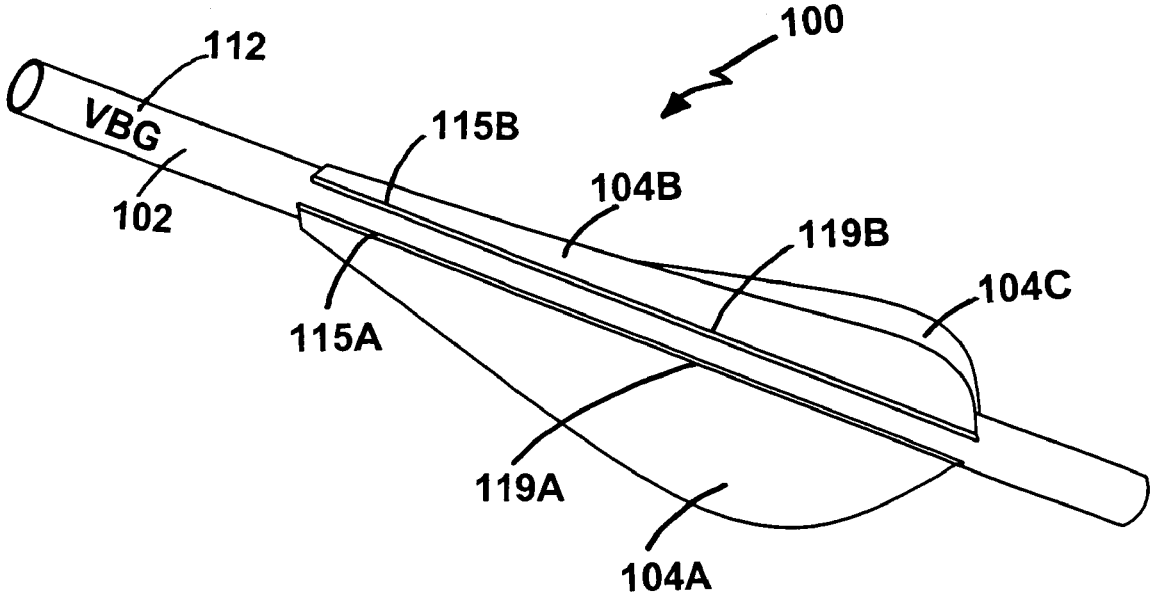
FIG. 2 is an a perspective side view of the arrow fletching assembly shown in FIG. 1 apart from the arrow.

FIG. 1 is a perspective view of an exemplary embodiment of an arrow fletching assembly, generally indicated at 100, mounted on the shaft 116 of an arrow, shown generally at 114, according to the present invention. Arrow fletching assembly 100 may include a sleeve 102 and a plurality of feathers or vanes 104 (referred to herein as "fletching members"). Sleeve 102 may be formed of a generally flexible vinyl, plastic or plastic-like material having a generally tubular shape. The diameter of the sleeve may be selected to snugly fit the outside of shaft 116. In one embodiment, sleeve 102 is placed on shaft 116 by sliding the tubular sleeve 102 over shaft 116 and rotating or adjusting the sleeve until the fletching members 104 are in the desired position. Sleeve 102 may be secured to the shaft 116 with adhesive strips 107 and 109 such that part of the strip 107 overlaps the proximal end 106 of the sleeve 102 and part of the strip 109 overlaps and is secured to the proximal end 111 of the shaft 102 or to the nock 110, depending upon the desired location of the fletching. Likewise, the adhesive strip 107 overlaps the distal end 108 of the sleeve 102 and also overlaps a portion of the shaft 102 adjacent the distal end 108 of the sleeve. The sleeve 102 is configured with a length to support the fletching members 104 along their entire length. In addition, the sleeve has a length or portion that extends beyond the distal ends of the fletching members 104 to provide space at the distal end 108 thereof for placement of a graphical element 112 thereon. Likewise, the sleeve provides an additional portion or length between the proximal end of the vanes 104 and the proximal end of the sleeve in order to provide proper spacing between the nock and the proximal ends of the vanes 104. Thus, when attaching the fletching assembly 100 to the shaft 102, the sleeve can be positioned, for example, with the proximal end 106 of the sleeve aligned with the joint between the shaft 102 and the nock 110. Such positioning is important for balance of the arrow 114 and performance of the arrow.

As shown in FIG. 2, arrow fletching assembly 100 may include feathers 104 of any conventional shape and quantity. According to an alternative embodiment, arrow fletching assembly 100 may have vanes 104 formed of vinyl or any other suitable flexible plastic material. The feathers or vanes 104 may be adhered to the sleeve 102 using glue or any suitable adhesive according to an embodiment of the present invention. As such beads of adhesive 115A and 115B extend along the bottom or attachment edges 119A and 119B of vanes 104A and 104B, respectively. The adhesive beads 115A and 115B attach the vanes 104 to the sleeve 102. Similarly, an adhesive layer could be provided on each vane for attachment of the vanes. The vanes 104A, 104B and 104C are helically oriented around the sleeve 102 so as to impart the proper spin on the arrow as the vanes 104 travel through the air. Conventional vane placement technology may be implemented with the present invention in order to properly align the vanes 104 relative to the sleeve 102 during attachment. The feathers or vanes 104 may all be the same color according to an embodiment of the present invention. Alternatively, there may be a single cock feather 104A of a distinctive color or finish and the remaining feathers 104B and 104C may be of a different color or finish. There may be three, four or any other suitable number of feathers or vanes 104 spaced generally equidistant around the circumference of the sleeve 102 according to embodiments of the present invention. A particular advantage of embodiments of the present invention is the use of brightly colored or highly visible feathers or vanes 104. This feature is particularly advantageous when retrieving arrows 114 fired in the field for reuse.

Graphics 112, which may or may not include high visibility colors, according to an embodiment of the present invention may be printed directly on the sleeve 102 or provided on a separate adhesive element, such as an adhesive-backed sticker with the graphics 112 printed on it and then adhered to the tubular sleeve 102. Likewise, the sleeve 102 may be formed from a high visibility material, such as a plastic material impregnated with a high visibility color or having a high visibility coating applied to its outer surface. Such high visibility materials or coatings may include various colors, such as white, yellow, various fluorescent colors, self-illuminating substances and materials and the like.

Because of the desire in the industry to customize arrows, including, but not limited to, the number of vanes, the materials from which the vanes are formed, the colors of the vanes and the size of the vanes, one particular advantage of the present invention is to provide the tubular sleeves 102 separately from an associated plurality of feathers or vanes 104. One of the major expenses of archery shops is the necessity to purchase and have on hand a variety of shaft/vane combinations so that a customer can purchase a desired shaft/vane/color combination. This requires such archery shops to stock and thus inventory dozens of different types of arrows. A particular advantage of the present invention to such archery shops is the ability to stock a plurality of vane assemblies, separate from the shafts so that a customer can select a particular type of shaft and a particular vane/color combination that can be combined by the archer or the archery shop at the time of purchase. In addition, archery shops could be provided with a kit comprising the tubular sleeve, fletching members, adhesive for attaching the fletching members to the sleeve and tape segments for attaching the tube to an arrow shaft. Moreover, the archery shops could create their own kits by obtaining the sleeves and then providing their own fletching members from another source. Thus, the archery shop can make up a few fletching assemblies based upon that stores particular customer base and stock fewer shafts. Moreover, the archery shop can be provided with custom graphics 112 on the sleeve 102 specific to that shop such that the fletching assembly becomes a means to advertise for the archery shop.

Alternatively, the tubular sleeve 102 may be packaged and sold in kit form with a sleeve, a plurality of feathers or vanes 104 and adhesive for attaching the fletching members 104 to the sleeve 102 by the purchaser.

Figure 3:
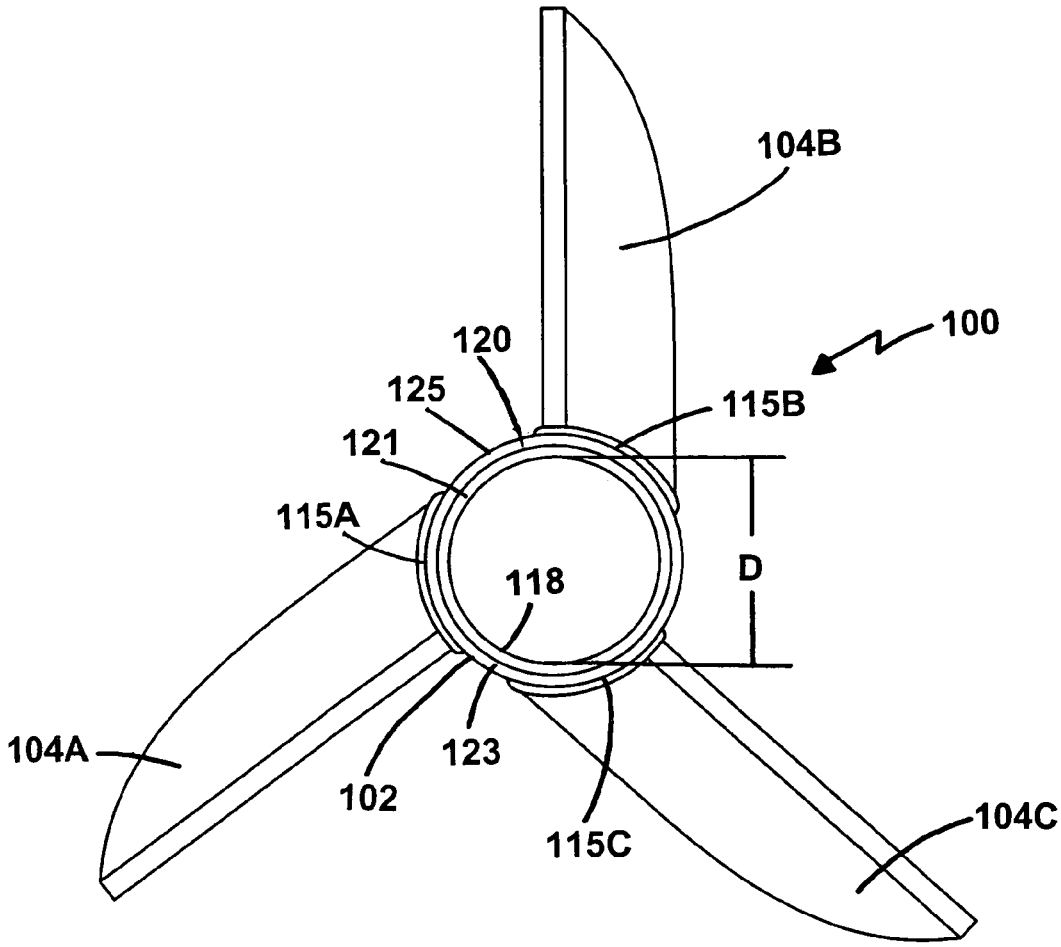
FIG. 3 is a proximate end view of the arrow fletching assembly illustrated in FIGS. 1 and 2.

FIG. 3 is a proximate end view of the arrow fletching assembly 100 illustrated in FIGS. 1 and 2. Arrow fletching assembly 100 includes a tubular sleeve 102. The tubular sleeve 102 is comprised of an inner tube 121 having an inside surface 118 for receiving and fitting relatively snugly around an arrow shaft 116 (see FIG. 1). Inner tube 121 includes an outer surface 120 to which an outer layer 123 is applied, as with an adhesive layer. The outer layer 123 circumscribes the inner tube 121. Graphics may be printed on the outer surface 125 of the outer layer 123. The fletching members 104A, 104B and 104C are attached to the outer surface 125 of the outer layer 123 with adhesive beads 115A, 115B and 115C, respectively. Outer surface 125 may also be configured for mounting a plurality of feathers or vanes 104 (three vanes shown in FIG. 3) according to embodiments of the present invention. The feathers or vanes 104 may be mounted on tubular sleeve 102 in a helical configuration as shown to promote spinning of the arrow 114 along its longitudinal axis during flight. The inner tube 121 is configured with a diameter, D, suitable for a snug or relatively close fit over arrow shafts having any outside diameter as noted below.

The outer layer 120 may be formed of a clear or opaque material or other suitable material according to embodiments of the present invention. For example and not by way of limitation, the outer layer 120 may be formed from 3M® brand vinyl sign material having a thickness ranging from about 0.006" to about 0.0010". The graphics 112 printed on the outer layer 121 may include high visibility colors that are useful for retrieving an arrow 114 that has been shot into the field and may otherwise be difficult to see or locate because of surrounding foliage. Thus, the outer layer 120 is provided as a sticker that is applied to the inner tube 121. Likewise, the material itself of the layer 120 may be formed of a colored material having high visibility, such as fluorescent coloring, a material having high reflective properties Such high visibility materials or a coating having high visibility or reflective properties. Such high visibility or reflective properties may provided by various colors, such as white or yellow, various fluorescent colors, or shiny or mirror-like materials, and the like. In addition, the outer layer 120 may be formed from a material that exhibits light storing and emitting capabilities, such as materials commonly referred to as "glow-in-the-dark." Such glowing materials can be charged, as by exposure to a bright light source prior to shooting in low-light conditions. The arrow could then be easily found by the archer by the arrow being illuminated against the background. This feature can significantly reduce the number of a arrows that are lost in the field in low ambient light conditions.

A significant advantage of providing an outer layer 120 in sheet form to the inner tube 121 is the ease of applying a desired graphical element to the sheet prior to application over the sleeve. Because of the relatively small size of the inner tube 121, it would be more expensive and difficult to have the inner tube tubular sleeves themselves printed with a customized logo. It is, however, relatively easy and inexpensive to provide a sticker having the desired logo or graphical element printed thereon. The stickers, once printed, can then be applied to the tube 121 prior to attachment of the fletching members thereto.

As shown in FIG. 1, the arrow fletching assembly is attached to the shaft 116 with tape segments 107 and 109 for securing the tubular sleeve 102 to the arrow shaft 116. The tape segments may be translucent, as illustrated, or formed from an opaque material that matches the color of the sleeve 112. The use of tape facilitates field adjustment of the arrow fletching assembly 100 if necessary. Alternatively, an adhesive may be used to secure tubular sleeve 102 to the arrow shaft 116 according to another embodiment of the present invention. In such adhesive applications, a small drop of adhesive may be applied to one or both ends of the fletching assembly 100 to essential "tack" the sleeve 112 to the shaft 116. In either case, the sleeve 112 can be easily and quickly removed from the shaft 116 without damaging the shaft 116. With typical fletching attachment techniques, the vanes 104 are adhesively attached directly to the shaft 116. As such, when vanes are damaged or need to be replaced, the vane must be scraped from the shaft of the arrow. With graphite shafted arrows, such scraping produces significant damage to the shaft and can eventually render the arrow unusable. With the present invention, the fletching assembly 100 can be replaced or adjusted as needed, even in the field by simply removing the tape 107 and 109, repositioning or replacing the fletching assembly 100 and reattaching the fletching assembly 100 with tape segments 107 and 109. Such fletching adjustment is sometimes desirable in the filed if the archer notices that the fletching assembly 100 is not tuned to the broadhead 150. That is, it is typically desired to have the leading edges of the vanes 104 to align with the blades of the broadhead for proper arrow flight. With the present invention, such fletching assembly adjustment can be easily and quickly performed in the field.

Tubular sleeve 102 may be configured to snugly fit arrow shafts 116 formed of any material and having any outside diameter ("OD"). For example and not by way of limitation, tubular sleeve 102 may be configured to fit a standard arrow shaft 116 outside diameter such as OD=0.265" or OD=0.295" or OD=0.280" or OD=0.312" or OD=0.300". Of course any other shaft outside diameters, for example those used in crossbow bolts, may receive arrow fletching assemblies 100 with tubular sleeves 102 as disclosed herein. Shafts 116 may be formed of aluminum tubing, graphite, fiberglass, wood and any other suitable arrow shaft material.

Figure 4:
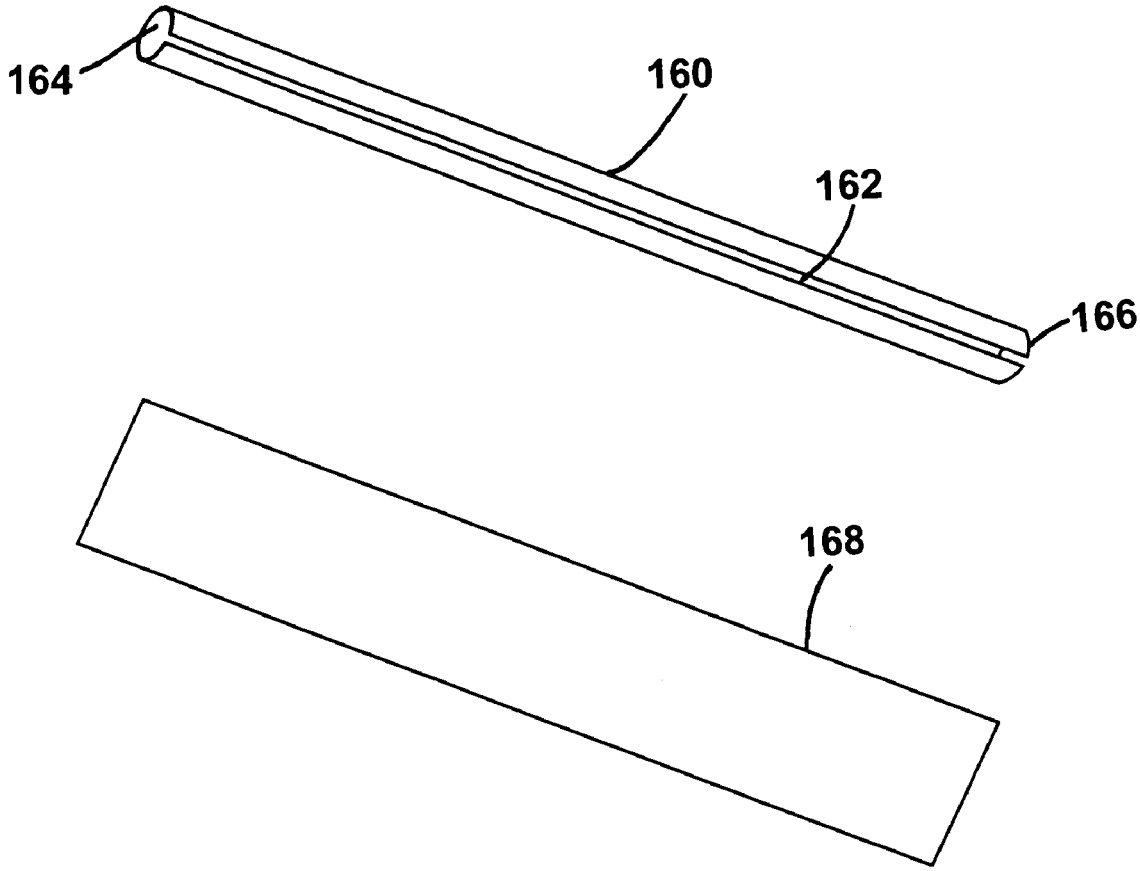
FIG. 4 is a perspective side view of an alternative embodiment of an inner tubular member and adhesive segment in accordance with the principles of the present invention.

As shown in FIG. 4, in order to produce a fletching assembly, such as fletching assembly 100, that can fit a variety of OD arrow shafts, the fletching assembly may be comprised of an inner tubular member 160 configured with an elongate cut extending from a proximate end 164 to a distal end 166. By including such a cut or slit along the length of the inner tubular member 160, larger diameter arrow shafts 116 may be accommodated with a single size of inner tubular member 160. In addition, the inner tubular member 160 will custom fit virtually any sized shaft to produce a snug fitting inner tubular member 160 regardless of shaft size. When combined with a rectangular segment of a resilient, adhesive-backed material 168, the tubular member 160 forms a snug, interference fit around the shaft. That is, the segment 168 is wrapped around the tubular member 160 to close the gap in the cut 162 around the shaft. The segment 168 may be positioned over the tubular member 160 so that a center of the segment 168 overlies the cut 162. Because the segment is resilient, tightly wrapping the segment 168 around the tubular member 160 will cause a slight stretch in the segment and bias the cut 162 in the tubular member 160 toward a closed position. The arrow fletching assembly-formed from the components of FIG. 4 may be secured to the shaft using tape or adhesives as described above.

Yet another embodiment of an arrow fletching assembly 100 may include a tubular sleeve 102 having an inner surface configured to encircle an arrow shaft 116 and having an outer surface configured with high visibility graphics. This embodiment of an arrow fletching assembly 100 may further include a plurality of vanes attached to the outer surface of the tubular sleeve 102. The vanes may be integrally formed with and of the same material as the tubular sleeve 102 according to another embodiment of the present invention.

According to yet another embodiment of an arrow fletching assembly 100, the vanes or feathers 104 may be helically 122 aligned along the outer surface 120 of the tubular sleeve 102. The helical 122 alignment of the vanes or feathers 104 causes the arrow 114 to spin about its longitudinal axis when released into the air. The plurality of vanes or feathers 104 may include a single cock feather 104A according to embodiments of the present invention. The cock feather 104A may be formed of a different color or have a particular graphic or surface feature that distinguishes it from the other feathers 104B mounted on the tubular sleeve 102. The purpose for a cock feather 104A is to give the user a visual tool for aligning the arrow 114 prior to nocking it on the bow string. For example, in a three feather configuration, a cock feather 104A may be generally aligned perpendicular to the plane of the bow. The present invention allows for easy placement of the fletching assembly upon the shaft with the cock feather 104A in the desired location so as to prevent interference of the cock feather with the bow when shooting. As such, with the present invention, it is no longer necessary to attach the nock of the arrow after fletching to ensure that the cock feather is in the proper location. Moreover, arrows formed according the present invention can be quickly and easily modified to reorient the cock feather when using a particular arrow in different bows where cock feather reorientation may be desired.

In general, the arrow fletching assembly of the present invention may include a tubular sleeve having an inner surface configured to encircle an arrow shaft and include an outer surface configured with high visibility graphics according to the present invention. Additionally, the outer surface 120 may also be configured for mounting a plurality of vanes. For example and not by way of limitation, arrow fletching assembly may include three feathers adhesively and helically adhered to the outer surface of the tubular sleeve. One of the three feathers may be a cock feather of a different color than the other two feathers. Alternatively, arrow fletching assembly may include four feathers adhesively and helically adhered to the outer surface of the tubular sleeve.

Embodiments of tubular sleeve may be formed of vinyl, heat activated shrink-wrap material, or any other suitable plastic or plastic-like material consistent with the principles of the present invention. Tubular sleeve may be configured to snugly fit arrow shafts of any suitable outside diameter as described herein.

Figure 5:
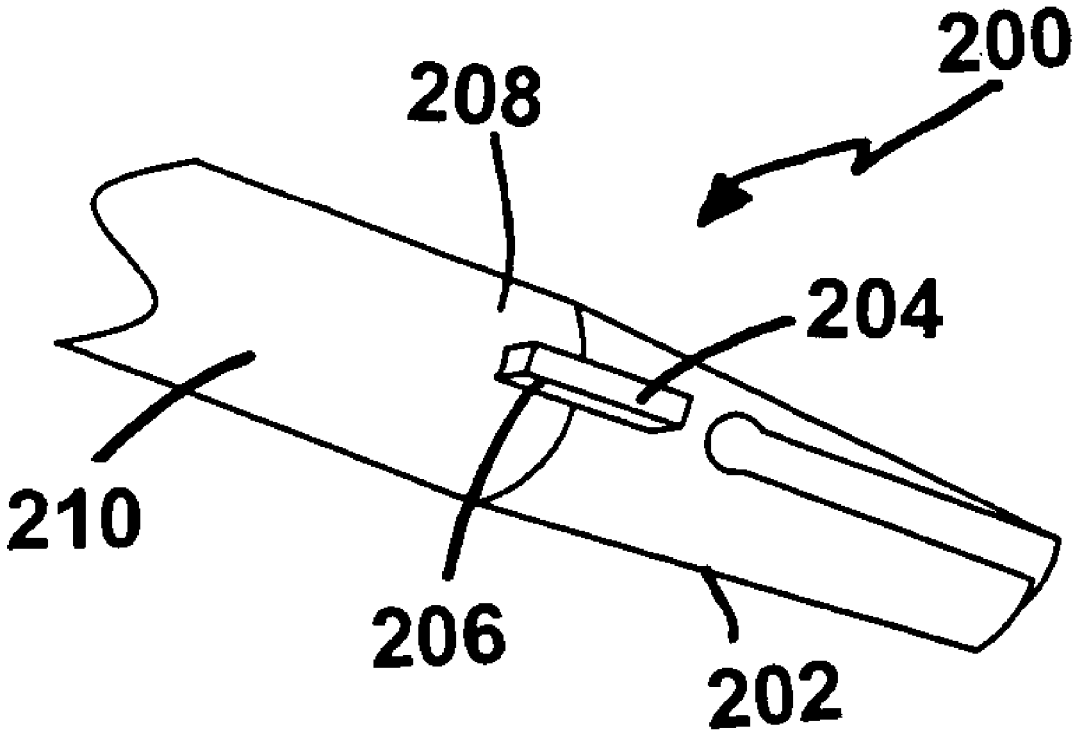
FIG. 5 is a partial perspective side view of an alternative embodiment of a nock and fletching assembly in accordance with the principles of the present invention.

The arrow fletching assembly of the present invention may further include an arrow shaft around which the arrow fletching assembly is placed. According to another embodiment of an arrow fletching assembly 200, as shown in FIG. 5, a nock 202 may be provided with a raised protrusion 204 affixed thereto for mating with a corresponding slot 206 formed in the proximal end of the tubular sleeve 210 of the of the arrow fletching assembly 200. The protrusion 204 provide proper alignment between the nock 202 and the sleeve 210 and prevents rotation of the sleeve 210 relative to the nock 202 and thus relative to the arrow itself.

It is understood that the terminology used herein is used for the purpose of describing particular embodiments only and is not intended to limit the scope of the present invention. It is also understood that, as used herein and in the appended claims, the singular forms "a," "an," and "the" include plural reference, unless the context clearly dictates otherwise.

Unless defined otherwise, all technical and scientific terms used herein have the same meanings as commonly understood by one of ordinary skill in the art to which this invention belongs. While various methods, compositions, and materials of the present invention are described herein, any methods and materials similar or equivalent to those described herein may by used in the practice or testing of the present invention. All references cited herein are incorporated by reference in their entirety and for all purposes.

While the foregoing advantages of the present invention are manifested in the illustrated embodiments of the invention, a variety of changes can be made to the configuration, design and construction of the invention to achieve those advantages. Hence, reference herein to specific details of the structure and function of the present invention is by way of example only and not by way of limitation.

What is claimed is:

1. An arrow fletching assembly, comprising:

a tubular member having an inner surface configured to encircle an arrow shaft and having an outer surface, a sheet applied to said outer surface of said tubular member; and a plurality of fletching members attached to the sheet.

2. The arrow fletching assembly of claim 1, wherein the sheet is provided with graphics printed on an exposed side thereof.

3. The arrow fletching assembly of claim 1, wherein the sheet includes at least one of high visibility colors, glow-in-the dark properties and reflective properties.

4. The arrow fletching assembly of claim 1, further comprising an adhesive-backed segment for securing the tubular member to the arrow shaft.

5. The arrow fletching assembly of claim 1, wherein the tubular member is configured to relatively snugly fit arrow shafts having an outside diameter of approximately 0.265 inches to 0.312 inches.

6. The arrow fletching assembly of claim 1, wherein the tubular member is configured with a cut extending from a proximal end to a distal end.

7. The arrow fletching assembly of claim 6, wherein said sheet is formed of a resilient material and biases said cut toward a closed position.

8. An arrow fletching assembly, comprising:

a first tubular member configured to encircle an arrow shaft;

a second tubular member disposed over said first tubular member and attached thereto; and a plurality of fletching members attached to said second tubular member.

9. The arrow fletching assembly of claim 8, wherein said first tubular member is formed from a plastic tube and said second tubular member is formed from an adhesive-backed sheet of plastic material.

10. The arrow fletching assembly of claim 9, wherein the second tubular member is comprised of vinyl.

11. The arrow fletching assembly of claim 8, wherein the first tubular member is comprised of a heat activated shrink-wrap material.

12. The arrow fletching assembly of claim 8, wherein the first tubular member is configured with a cut extending from a proximal end to a distal end.

13. The arrow fletching assembly of claim 12, wherein said second tubular member is formed of a resilient material and biases said cut toward a closed position.

* * * * *